United States Patent [19]

Oki et al.

[11] Patent Number: 4,484,440

[45] Date of Patent: Nov. 27, 1984

[54] EXHAUST MANIFOLD OF DUAL TYPE FORMED WITH CHAMBER TO RECEIVE EXHAUST GAS SENSOR

[75] Inventors: Yoshitaka Oki; Takeshi Tanuma, both of Yokohama, Japan

[73] Assignee: Nissan Motor Company, Limited, Yokohama, Japan

[21] Appl. No.: 433,425

[22] Filed: Oct. 8, 1982

[30] Foreign Application Priority Data

Oct. 26, 1981 [JP] Japan ..... 56-159492[U]

[51] Int. Cl.[3] ..... F01N 3/18

[52] U.S. Cl. ..... 60/276; 60/323

[58] Field of Search ..... 60/276, 282, 302, 323

[56] References Cited

FOREIGN PATENT DOCUMENTS

| | | | |
|---|---|---|---|
| 2725944 | 12/1978 | Fed. Rep. of Germany | 60/276 |
| 19002 | 2/1979 | Japan | 60/276 |
| 158515 | 12/1979 | Japan | 60/276 |
| 56-27394 | 6/1981 | Japan | 60/276 |

*Primary Examiner*—Douglas Hart

*Attorney, Agent, or Firm*—Schwartz, Jeffery, Schwaab, Mack, Blumenthal & Koch

[57] ABSTRACT

An exhaust manifold for a multicylinder internal combustion engine which may be an automotive engine. The manifold is of the dual type having a wall formed in the interior to serve as a partition between two separate exhaust gas passages which are communicable with first and second groups of engine cylinders, respectively. To enable installation of an exhaust gas sensor in the manifold, the partition wall has a generally cup-shaped portion which provides therein a chamber to receive the sensitive part of the sensor. The cylindrical side wall of the cup-shaped portion is formed with at least two fairly narrow apertures which provide fluid communication between the inner chamber and the two exhaust gas passages, respectively. In operation, small fractions of the exhaust gases flowing in the two separate passages enter the sensor chamber in the cup-shaped portion of the partition wall to enable detection of an average concentration of a specific component, e.g. oxygen, of the separately flowing exhaust gases without causing substantial mixing or interference of the two exhaust gas flows with each other.

2 Claims, 3 Drawing Figures

EXHAUST MANIFOLD OF DUAL TYPE FORMED WITH CHAMBER TO RECEIVE EXHAUST GAS SENSOR

BACKGROUND OF THE INVENTION

This invention relates to a dual type manifold for use in the exhaust system of a multicylinder internal combustion engine which may be an automotive engine, the manifold being designed so as to enable installation of an exhaust gas sensor.

In recent automobiles, often an exhaust gas sensor such as an oxygen sensor is installed in an exhaust manifold to serve as an element of a system for feedback control of the air/fuel ratio in the engine. When the exhaust manifold is a so-called dual manifold, which is formed with two separate exhaust gas passages that are allocated respectively to two groups of engine cylinders into which all the cylinders are divided based on the firing order for the purpose of preventing loss of the engine output power by an interference of the pressure of exhaust gas discharged from any cylinder with the flow of exhaust gas discharged from another cylinder, it is not so easy to appropriately install an exhaust gas sensor in the manifold. In the dual manifold, the exhaust gas sensor must be installed so as to detect an average concentration of the specified component, e.g. oxygen, of the exhaust gases flowing in the two separate passages in the manifold, and therefore it becomes necessary to locally cut out a wall which partitions the two exhaust gas passages from each other to thereby expose the sensitive part of the installed sensor to both of the two exhaust gas flows in the respective passages.

However, the cutout of the partition wall in the manifold provides fluid communication between the two exhaust gas passages and, hence, is liable to cause an interference of the two exhaust gas flows with each other. Furthermore, there arises a possibility that the partition wall will suffer cracking in a region contiguous to the cutout as the wall undergoes repeated thermal expansion and shrinkage. Besides, when after-burning of the exhaust gases occurs in the exhaust manifold of this type the sensitive part of the exhaust gas sensor directly exposed to the exhaust gas flows in the two passages is liable to be damaged by the action of the exhaust gas pressure augmented by the after-burning. In conventional exhaust manifolds of dual manifold type, the above described problems relating to the installation of an exhaust gas sensor have not yet been solved completely.

SUMMARY OF THE INVENTION

It is an object of the present invention to provide an improved exhaust manifold of the dual type, in which an exhaust gas sensor can be installed such that the sensor can accurately detect an average concentration of a specific component of the exhaust gases flowing in the two exhaust gas passages in the manifold without accompanied by the above described unfavorable side-effects of the installation of the sensor.

An exhaust manifold according to the invention comprises a manifold body formed with an opening for insertion of a sensitive part of an exhaust gas sensor into the manifold, and a wall formed in the interior of the manifold body so as to serve as a partition between two separate exhaust gas passages which extend in the manifold body and are communicable with first and second groups of the engine cylinders, respectively. As the primary feature of the invention, the aforementioned partition wall comprises a generally cup-shaped portion to receive therein the sensitive part of the exhaust gas sensor. This generally cup-shaped portion has an open end contiguous to the aforementioned opening in the manifold body, a closed bottom at the opposite end and a generally cylindrical side wall extending from the open end to the closed bottom. The cylindrical side wall is formed with at least two relatively small apertures which provide fluid communication between the space in the generally cup-shaped portion and the two separate exhaust gas passages, respectively.

The cup-shaped portion of the partition wall is shaped such that when the exhaust gas sensor is installed in the manifold the sensitive part of the sensor as well as a protective cover for the sensitive part, if any, is entirely spaced from the closed bottom and the cylindrical side wall of the cup-shaped portion, so that a generally annular space is left between the sensitive part of the sensor and the side wall of the cup-shaped portion.

In an exhaust manifold according to the invention, only fractions of the exhaust gases flowing in the two separate exhaust gas passages formed in the manifold flow into the sensor chamber defined in the cup-shaped portion of the partition wall through the fairly narrow apertures in the side wall of the cup-shaped portion. Accordingly, the detection of an average concentration of a specific component of the exhaust gases flowing in the two passages can be performed without causing substantial mixing or interference of the two exhaust gas flows with each other. Owing to the cup-like shaping of the sensor receiving portion of the partition wall, the provision of the sensor receiving portion does not weaken the mechanical strength of the partition wall. Furthermore, the confinement of the sensitive part of the exhaust gas sensor is effective for protection of the sensitive part from damages by the actin of the exhaust gas pressures even when after-burning occurs in the manifold.

DESCRIPTION OF THE PREFERRED EMBODIMENTS

Figure 1:
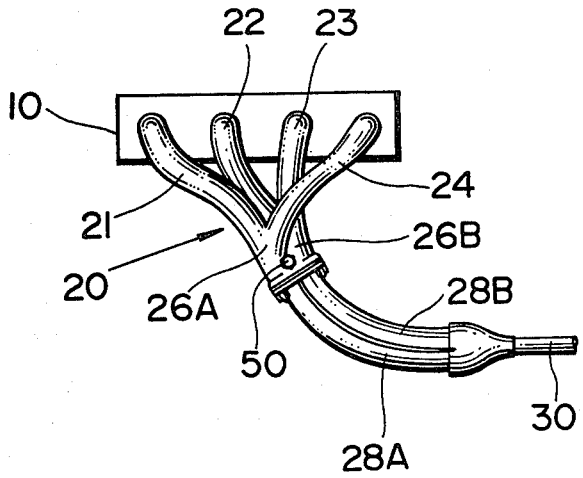
FIG. 1 is a schematic elevational view of an exhaust manifold of dual manifold type to which the present invention is applied for the installation of an exhaust gas sensor in the manifold.

FIG. 1 shows an outline of an exhaust manifold 20 of dual manifold type designed for a four-cylinder automotive internal combustion engine 10. This exhaust manifold 20 has four branches 21–24 connected respectively to the exhaust ports of the four cylinders of the engine 10. The first branch 21 connected to the exhaust port of No. 1 cylinder joins the fourth branch connected to No. 4 cylinder at a joint section 26A in the manifold 20, while the second branch 22 connected to No. 2 cylinder joins the third branch 23 connected to No. 3 cylinder at another joint section 26B, which is partitioned from the former joint section 26A in order to avoid an interference of exhaust gas pressures in the respective branches 21–24 of the manifold 20. An outlet end portion of the manifold 20 is formed with two exhaust gas passages (not shown in FIG. 1) that are partitioned from each other and extending from the aforementioned two joint sections 26A and 26B, respectively. At the outlet end of the manifold 20, two exhaust pipes 28A and 28B are connected respectively to the two exhaust gas passages in the manifold 20 so that the exhaust gases from Nos. 1 and 4 cylinders are discharged from the manifold 20 separately from the exhaust gases from Nos. 2 and 3 cylinders. At some distance from the exhaust manifold 20, these two exhaust pipes 28A and 28B are joined into a single exhaust pipe 30.

To detect an average concentration of a specific component, e.g. oxygen, of the exhaust gases discharged from the four cylinders of the engine 10 while the temperature of the exhaust gases is high enough for accurate detection by an electrochemical technique, an exhaust gas sensor 50 such as an oxygen sensor of the oxygen concentration cell type is installed in the outlet end portion of the exhaust manifold 20 such that the sensitive part of the sensor 50 is exposed to both of the two exhaust gas flows in the aforementioned two exhaust gas passages formed in this portion of the manifold 20.

According to the invention, the outlet end portion of the exhaust manifold 20 is formed such that the exhaust gas sensor 50 can be installed so as to fully serve its purpose without producing unfavorable side-effects.

Figure 2:
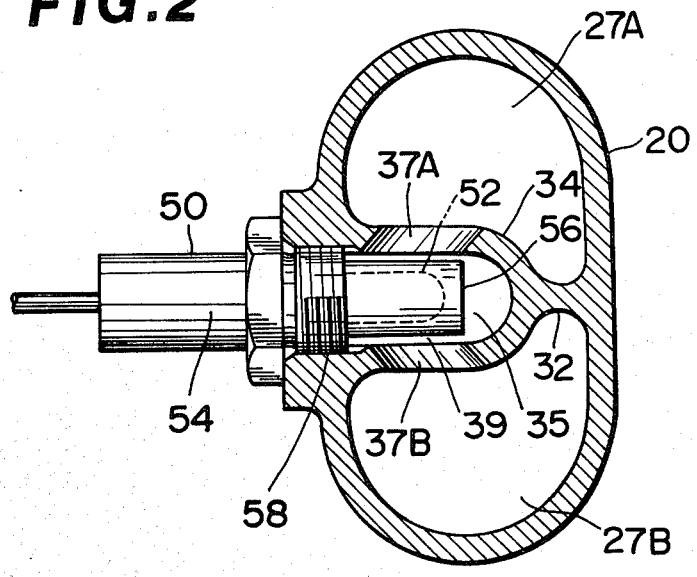
FIG. 2 is a sectional view of an exhaust manifold embodying the present invention at a section where an exhaust gas sensor is installed in the manifold.

As a first embodiment of the invention, FIG. 2 shows the interior of the outlet end portion of the exhaust manifold 20 in FIG. 1. In FIG. 2 indicated at 27A and 27B are two exhaust gas passages formed as downstream end portions of the joint sections 26A and 26B shown in FIG. 1, respectively. To separate these two passages 27A and 27B from each other, there is a partition wall 32 which is formed integral with the body of the manifold 20. At a section suitable for the installation of the exhaust gas sensor 50 the partition wall 32 is locally made tubular so as to provide a generally cup-shaped portion 34, which is bottomed in the interior of the manifold 20 and has an open end contiguous to a hole in the manifold body. The generally cylindrical side wall of the cup-shaped portion 34 serves as part of the partition wall 32, and a cylindrical space 35 in the cup-shaped portion 34 is used as a sensor receiving chamber. The cylindrical side wall is formed with an aperture 37A which provides fluid communication between the sensor receiving chamber 35 and one (27A) of the two exhaust gas passages and another aperture 37B which provides fluid communication between the chamber 35 and the other exhaust gas passage 27B. In forming the manifold body by casting as is usual, the entire portion of the partition wall 32 including the cup-shaped portion 34 can be formed integral with the manifold body, and the apertures 37A and 37B can be formed either by using suitable sand cores in the casting operation or by subjecting the cast manifold body to a machining operation such as drilling. The cylindrical inner surface of the manifold body defining the aforementioned hole contiguous to the chamber 35 is threaded correspondingly to a threaded body of the exhaust gas sensor 50.

For example, the exhaust gas sensor 50 installed in the exhaust manifold 20 of FIG. 2 is an oxygen sensor whose sensitive part 52 is essentially a tube of an oxygen ion conductive solid electrolyte such as zirconia coated with thin electrode layers. The sensitive part protrudes from a threaded metal body 54, and a tubular cover 56 formed with small apertures (not shown) is attached to the sensor body 54 for physical protection of the sensitive part 52. Inserting the sensitive part 52 enclosed in the protective cover 56 into the chamber 35 in the cup-shaped portion 34 of the partition 32, the oxygen sensor 50 is fixed to the manifold 20 by using the interior thread 58 formed in the manifold body. The cup-shaped portion 34 is formed in such a shape and size that the protective cover 56 of the oxygen sensor 50 is entirely spaced from the inner surface of the cup-shaped portion 34, so that an annular space 39 is left between the cylindrical surface of the cover 56 and the cylindrical inner surface of the cup-shaped portion 34. The output terminals of the oxygen sensor 50 are electrically connected to a measurement circuit (not shown) in an air/fuel ratio control unit for example.

During operation of the engine 10, fractions of the exhaust gases flowing in the two separate passages 27A and 27B in the outlet end portion of the exhaust manifold 20 flow into the sensor receiving chamber 35 through the openings 37A and 37B formed in the wall of the cup-shaped portion 34 of the partition 32 and come into contact with the sensitive part 52 of the oxygen sensor 50 through the apertures in the protective cover 56. Since the annular space 39 between the cover 56 and the wall of the cup-shaped portion 34 extend over the entire length of the cover 56 and the sensitive part 52, there occurs efficient mixing of the fractions of the exhaust gases admitted into the chamber 35 through the two openings 37A and 37B. Accordingly the sensor 50 can perform accurate detection of an average concentration of oxygen in the exhaust gases flowing in the two passages 27A and 27B.

The openings 37A and 37B formed for sampling of the exhaust gases are fairly small in width, so that the fluid communication between the two exhaust gas passages 27A and 27B via these openings 37A, 37B does not cause substantial interference of the two exhaust gas flows in the respective passages 27A and 27B with each other. Therefore, the provision of the cup-shaped portion 34 in the partition 32 does not impede the principal function of the exhaust manifold 20 of dual manifold type. That is, this exhaust manifold 20 fully serves the purpose of minimizing the loss of the output power of the engine 10 by interference of exhaust gas pressures.

Even if after-burning of the exhaust gases occurs in the manifold 20, the augmented pressures attributed to the after-burning attenuate considerably while the pressures transmit through the narrow openings 37A, 37B in the cup-shaped portion 34 of the partition 32 before the arrival of the pressures at the sensitive part 52 of the oxygen sensor 50. Thus, this manner of installation of the sensor 50 in the manifold 20 has an effect of protecting the sensitive part 52 of the sensor 50 from being damaged by unusually high exhaust gas pressures. With respect to the manifold 20 itself, the formation of the roundish and symmetrical cup-shaped portion 34 in the partition 32 does not weaken the rigidity or toughness of the partition 32 or the manifold body. Accordingly this exhaust manifold 20 is sufficiently high in durability.

Figure 3:
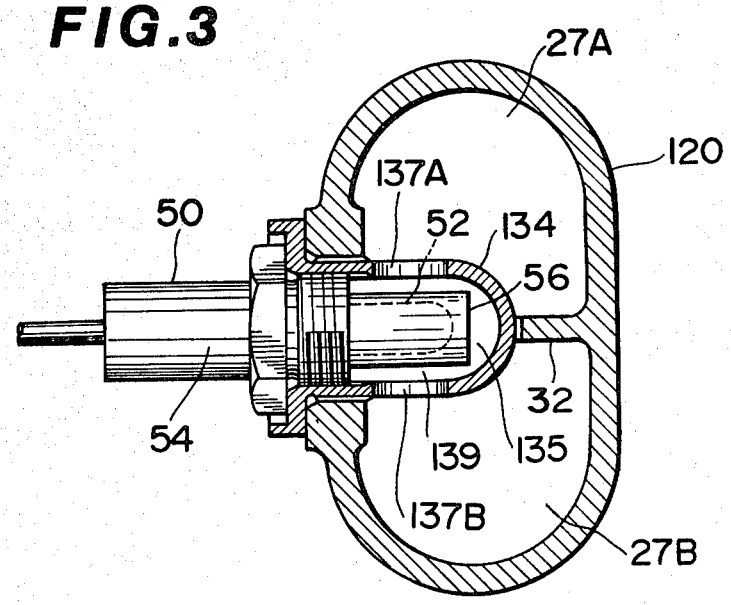
FIG. 3 shows a modification of the exhaust manifold of FIG. 2 in a similar sectional view as another embodiment of the invention.

FIG. 3 shows another embodiment of the invention. This exhaust manifold 120 of dual manifold type is generally similar to the manifold 20 described with reference to FIGS. 1 and 2, and is shown in a section corresponding to the section in FIG. 2. In this embodiment the partition 32 between the two exhaust gas passages 27A and 27B is locally cut out at a section suitable for installation of the exhaust gas sensor 50, and a sensor receiving member 134 formed as a separate part is inserted into the manifold 120 by using the cut in the partition 32 as an alternative to the cup-shaped portion 34 in the manifold 20 of FIG. 2. The sensor receiving member 134 is a generally cup-shaped member having a closed bottom and an open end. At the open end this member 134 is flanged, and an end portion contiguous to the flange is threaded on both the outer and inner sides. The cylindrical side wall of this member 134 is formed with fairly small openings 137A and 137B which correspond to the openings 37A, 37B in FIG. 2.

The cup-shaped member 134 is screwed into and fixed to the manifold body such that the closed bottom of this member 134 comes into contact, or nearly comes into contact, with the cut edge of the partition wall 32. The openings 137A and 137B are located such that these openings 137A and 137B provide fluid communiation between the cylindrical chamber 135 in the cup-shaped member 134 and the two exhaust gas passages 27A and 27B, respectively. Then the threaded metal body 54 of the oxygen sensor 50 is screwed into the cup-shaped member 134 fixed to the manifold 120. The sensor receiving member 134 is shaped almost similarly to the cup-shaped portion 34 in the manifold 20 of FIG. 2, so that the protective cover 56 of the sensor 50 in the chamber 135 is spaced from the inner surface of the member 134 to leave an annular space 139 between the cover 56 and the cylindrical wall of the sensor receiving member 134.

As will be understood, the embodiment of FIG. 3 is generally similar in effects to the first embodiment shown in FIG. 2. As an advantage of the embodiment of FIG. 3, it becomes easy to determine the conditions of the openings 137A, 137B such as the location, shape and/or the total number of the openings so as to be optimum to the responsiveness of the exhaust gas sensor 50 since the sensor receiving member 134 is formed separately from the body of the manifold 120. For example, the sensor receiving member 134 can be made sufficiently resistant to the high temperatures of the exhaust gases by using a normallized steel as its material and aluminizing the surfaces of the suitably shaped member 134.

What is claimed is:

1. An exhaust manifold for a multicylinder internal combustion engine, comprising:

a manifold body formed with an opening for insertion of a sensitive part of an exhaust gas sensor into the manifold; and a wall formed in the interior of the manifold body so as to serve as a partition between two separate exhaust gas passages which extend in the manifold body and are communicable with first and second groups of the engine cylinders, respectively, said wall comprising a generally cup-shaped portion to receive therein the sensitive part of said sensor, said generally cup-shaped portion having an open end contiguous to said opening in the manifold body, a closed bottom at the opposite end and a generally cylindrical side wall extending from said open end to said closed bottom, and being formed with at least two relatively small apertures which provide fluid comunication between the space in said generally cup-shaped portion and said two exhaust gas passages, respectively, and said generally cup-shaped portion being integral with the remaining portion of said wall partitioning said two exhaust gas passages.

2. An exhaust manifold according to claim 1, wherein said generally cup-shaped portion is shaped such that when said sensor is installed in the exhaust manifold the sensitive part of said sensor is entirely spaced from said closed bottom and said side wall of said generally cup-shaped portion.

* * * * *